US005624153A

United States Patent [19]

Censullo, Jr.

[11] Patent Number: 5,624,153

[45] Date of Patent: Apr. 29, 1997

[54] FOLDABLE CHAIR

[76] Inventor: Mario Censullo, Jr., 5108 Fort Hamilton Pky., Brooklyn, N.Y. 11219

[21] Appl. No.: 529,001

[22] Filed: Sep. 15, 1995

[51] Int. Cl.[6] ..... A47C 4/10; A47D 1/02

[52] U.S. Cl. ..... 297/59; 297/60; 297/16.1; 297/16.2

[58] Field of Search ..... 297/59, 60, 16.1, 297/16.2; 108/133, 115

[56] References Cited

U.S. PATENT DOCUMENTS

| | | | |
|---|---|---|---|
| 1,318,438 | 10/1919 | Follansbee | 297/59 |
| 1,341,150 | 5/1920 | Evangelist | 297/59 |
| 1,379,285 | 5/1921 | Pewther . | |
| 2,225,306 | 12/1940 | Kovats . | |
| 2,633,901 | 4/1953 | Norquist | 297/60 |
| 2,774,413 | 12/1956 | Shepherdson | 297/59 |
| 3,857,604 | 12/1974 | Scott . | |
| 4,629,245 | 12/1986 | Hardarson . | |
| 4,889,383 | 12/1989 | Jones | 297/16.1 |
| 5,375,906 | 12/1994 | Snyder . | |

FOREIGN PATENT DOCUMENTS

| | | | |
|---|---|---|---|
| 880087 | 10/1961 | United Kingdom | 297/60 |

*Primary Examiner*—Peter M. Cuomo
*Assistant Examiner*—Rodney B. White

[57] ABSTRACT

A folding chair comprising a front leg frame pivotally connected to a right sidebar and a left sidebar, a left and right sidebar pivotally connected to a rear leg frame, a seat member pivotable about a rear crossbar articulated to the rear leg frame, a back rest fastened to the extended rear legs, and a locking device that interlocks the seat member to the front and rear crossbar. By manually releasing the locking device, the front leg frame rotates forward and underneath into parallelism with the front portion of the right and left sidebars, and the right and left sidebars further rotates forward and on top of into parallelism with the lower end of the rear leg frame, allowing for the chair to fold to a consistent flat panel.

8 Claims, 4 Drawing Sheets

FOLDABLE CHAIR

BACKGROUND OF THE INVENTION

This invention relates to chairs, specifically to folding chairs.

In the design of folding chairs, prior art units have been made to fold to a compact unit where the back rest folds on top of the seat and the front and rear leg frames folds underneath the seat.

Although this compact design provides for ease of transportation and storage, nevertheless they become thicker in their compact position due to the support members folding on top of one another. In such compact position, these prior art units do not possess the structural elements for use a high quality area divider in a room or as an elegant furniture piece.

Other prior art units fold into a compact bundle requiring additional diagonal members for maintaining stability during the in-use position. Although convenient, ease of transport, and minimal space requirements these units are not suitable for complementing and enhancing a given room.

Several types of thin, flat chairs have been proposed—for example, U.S. Pat. Nos. 3,857,604 (1974) to Scott, and U.S. Pat. No. 4,629,245 (1986) to Hardarson. Although inexpensive to manufacture, require minimal space, and ease of transport, such chairs do not provide full back rests, since the back rests pivot to fold to a flat position.

The invention disclosed is based on the object of developing a folding chair that has a simple and elegant orthogonal structure that folds into a logical, coherent structure without increasing the profile depth of the chair when folded to a flat position. Besides the advantages described, this chair requires minimal space for storage, used in conjunction with a base support it functions as a area room divider when folded flat, and provides a full back rest.

REFERENCE NUMERALS IN DRAWINGS

REFERENCE NUMERALS IN DRAWINGS

| | | | |
|---|---|---|---|
| 12 | chair | 46 | dowel insert |
| 14 | front crossbar | 47 | concavity |
| 16R | right sidebar | 48 | fastener |
| 16L | left sidebar | 49 | fastener |
| 16' | bottom surface of sidebar | 50 | hinge support |
| 16" | front surface of rabbeted leg | 51' | front inside surface of notch |
| 17' | top surface of extremities of sidebar | 51" | bottom surface of hinge support |
| 17" | upper surface of rabbeted pivot means | 52 | ball bearing |
| 18 | rear crossbar | 53' | top inside surface of notch |
| 20 | back rest | 53" | top surface of hinge support |
| 22 | seat member | 54 | hollow |
| 24 | seat frame | 56 | latch |
| 26 | pin fastener | 57 | torsion spring |
| 28R | right bracket | 58 | groove |
| 28L | left bracket | 60 | socket |
| 30 | socket | 61 | socket |
| 32 | socket | 62 | pin |
| 35 | through-hole | 63 | socket encasement |
| 36 | socket | 64 | base support |
| 37 | socket | 65 | pivot means |
| 38 | latch | 66 | base support |
| 39 | groove | F1 | front leg |
| 40 | handle | F2 | front leg |
| 42 | wire | R1 | rear leg |
| 44 | wire | R2 | rear leg |

DESCRIPTION AND OPERATION OF THE PREFERRED EMBODIMENTS

It is to be understood that the phraseology or terminology employed herein is for the purpose of description and not of limitation.

Figure 1:
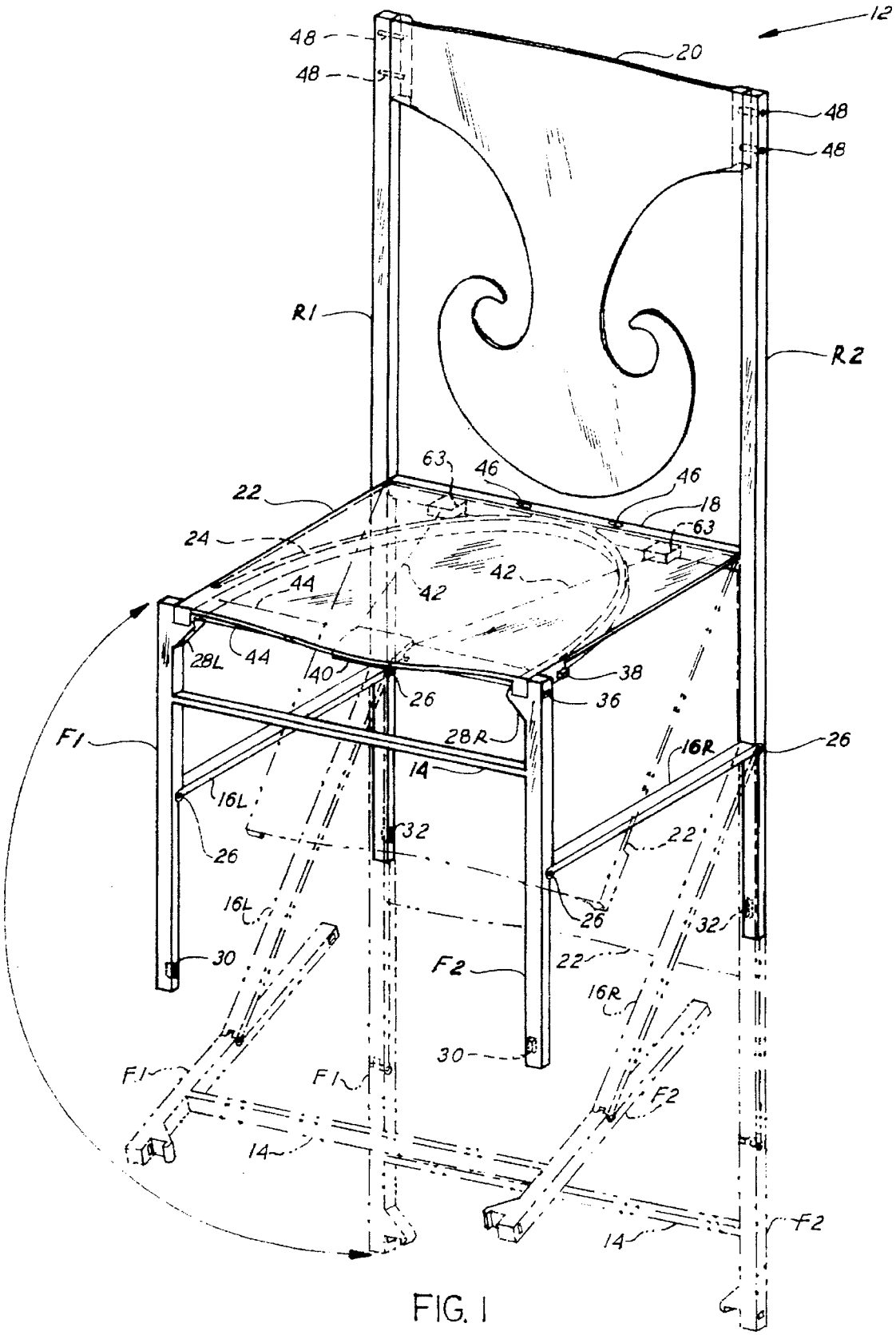
FIG. 1 shows a three-dimensional representation of a folding chair embodying the features of the present invention, the chair being shown in the open position with solid lines and the folded position in shown in broken lines.

The preferred material of the disclosed chair is a light weight metal such as aluminum alloy bars, and aluminum alloy cast seat and back rest. Other suitable materials such as steel, plastic, may be used. The preferred form of the invention herein disclosed is generally denoted chair 12. A typical embodiment of the present invention is illustrated in FIG. 1. The folding chair 12 comprises a front leg frame, a rear leg frame, a seat member including a seat frame, a right sidebar, and a left sidebar. The front leg frame comprises of a pair of front legs F1 and F2 interconnected by front bar 14. The rear leg frame comprises a pair of rear legs R1 and R2 interconnected by rear crossbar 18. The seat member 22 is hingedly connected to rear cross bar 18. The rear legs being longer that the front legs allows the mounting of a back rest 20 in the preferred shape shown, by fastener 48 However, chair 12 may also be designed as an ordinary stool without a back rest.

As seen in FIG. 1 front leg F2 is hingedly connected to right sidebar 16R with pin fastener 26. Rear leg R2 is hingedly connected to right sidebar 16R with pin fastener 26. Similarly, F1 is hingedly connected to left sidebar 16L with pin fastener 26, and rear leg RI is hingedly connected to left sidebar 16L. The front leg frame is manually disengaged from the locking device at seat member 22, swung forward and underneath into parallelism with the fight and left sidebars 16R and 16L respectively. The front leg frame is further swung with sidebars 16R and 16L forward and on top of lower end of rear legs R1 and R2. Thereby, inverting and placing the front leg frame into a parallel and stack like manner with the rear leg frame.

Figure 3:
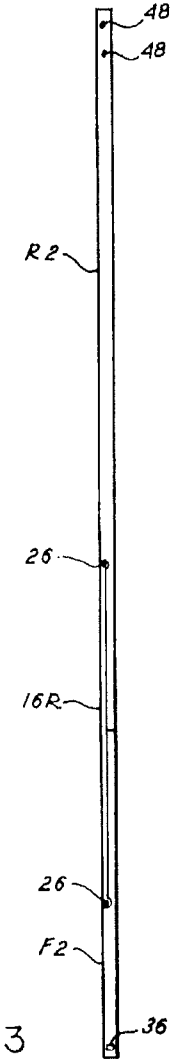
FIG. 3 shows the side elevation of the folding chair in a final folded stage.
Figure 2:
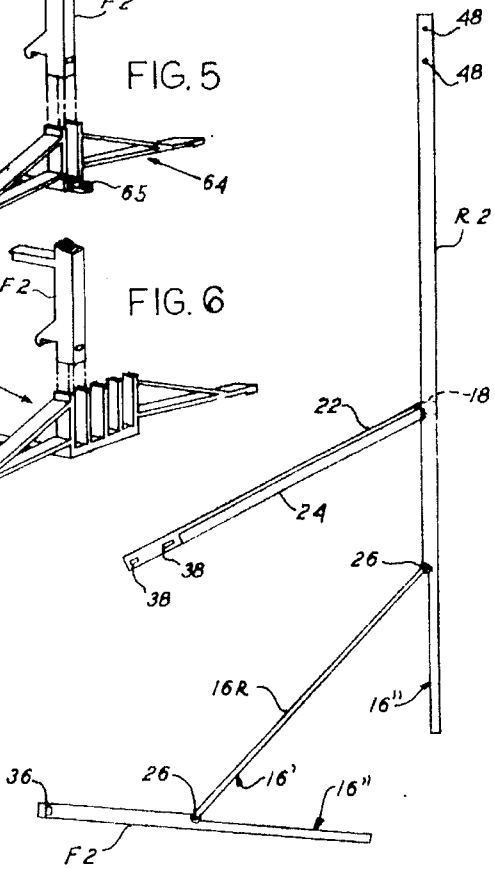
FIG. 2 shows the side elevation of the folding chair in a partial folded stage.

The lower ends of front legs F1 and F2, and that of rear legs R1 and R2 are rabbeted to match fit bottom surface 16' and top surface 16" shown in FIG. 2. Therefore, chair 12 assumes the folded position as a consistent flat panel as shown in FIG. 3. It is evident that the structural features described allow chair 12 to fold in a unique manner to a finally flat panel shown in side elevation in FIG. 3 and rear elevation in FIG. 4. Reversing the method of operation opens the folded chair into an extended position as shown in FIG. 1.

Figure 4:
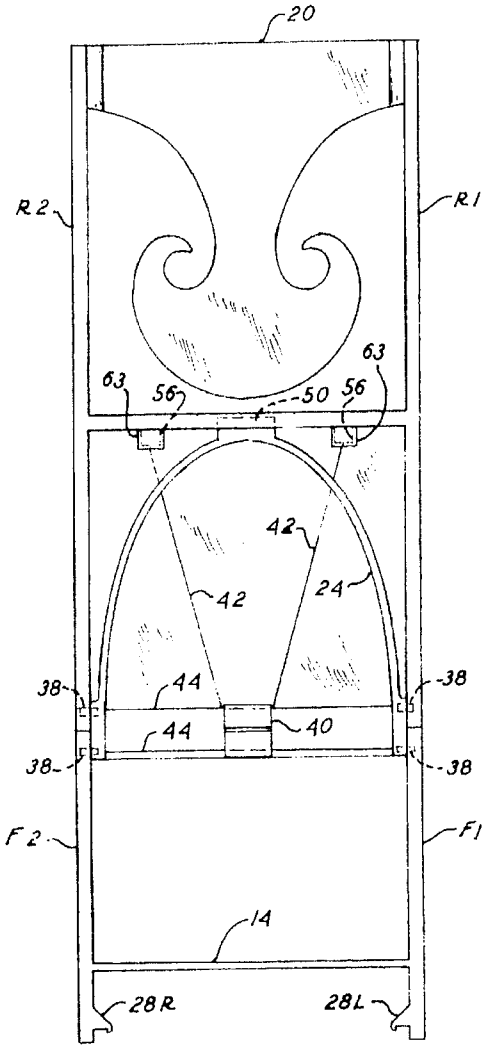
FIG. 4 the back elevation of the folding chair in a final folded stage.

To maintain chair 12 in the folded position, as shown in FIG. 4, latches 38 are engaged into sockets 30 of the lower ends of front legs F1 and F2, and into sockets 32 of the lower ends of rear legs R1 and R2. To open chair 12 to assume the extended position, handle 40 is pulled away from seat member 22 and disengages latches 38. Handle 40 is grooved the full width to engage with wire 44.

Figure 5:
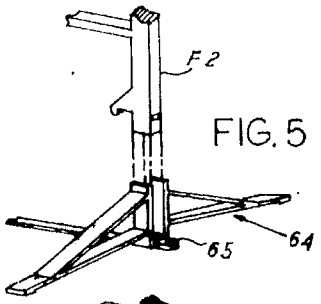
FIG. 5 shows a three-dimensional representation of a base support for the folding chair.
Figure 6:
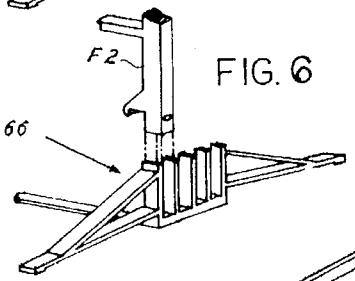
FIG. 6 shows a three-dimensional representation of an alternate base support for the folding chair.

Another object of the invention when chair 12 assumes the folded condition, is to mount chair 12 on a preferred base 64 shown in FIG. 5. In this configuration multiple chairs may be ganged together in adjacency for use in a room as an area divider by connecting extension plate 65 with a pin fastener to a duplicate base support 64. Or, simply stored in parallel stack manner using base support 66, as in FIG. 6.

Figure 7:
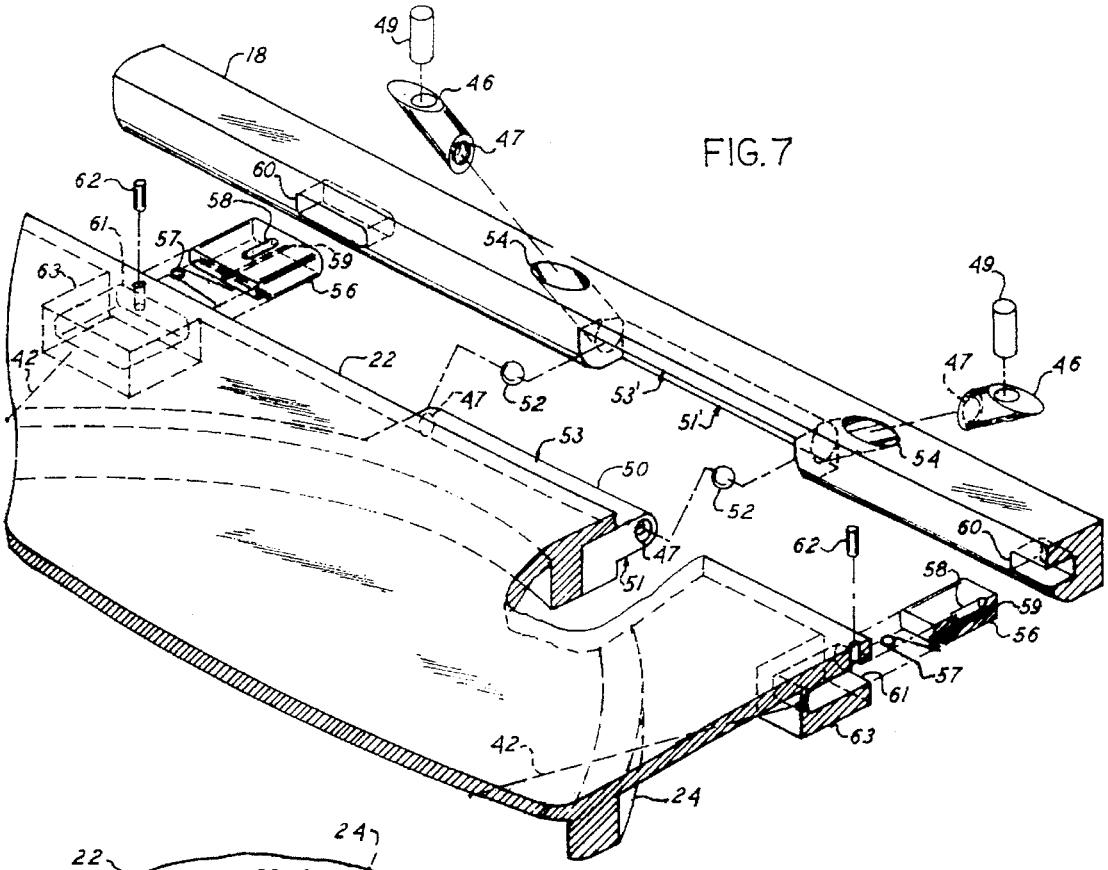
FIG. 7 shows an exploded partial three-dimensional representation of a hinge mechanism in accordance with the present invention, and a locking device in accordance with the present invention.

As seen in the exploded detail FIG. 7, hinge support 50 is connected to seat frame 24. Hinge support 50 is semi-rounded at the end, allowing for rotation about crossbar 18 and further comprises concavities 47 at both ends for engaging ball bearing 52. Dowel insert 46 has a concavity 47 for engaging ball bearing 52. Rear crossbar 18 has hollow 54 for holding dowel insert 46. Dowel insert 46 is secured by fastener 49 into hollow 54. Thus, hinge support 50 is engaged into notch at rear crossbar 18 and attached by the concealed hinge assembly described above. The concealed hinge assembly provides for the rotation of seat member 22 and for translating the weight applied to the seat member 22 to the rear crossbar 18. Rear crossbar 18 is quarter rounded to allow for seat member 22 to be swung down and between rear legs R1 and R2.

Referring to FIG. 7, top surface 53" of hinge support 50 is parallel and contiguous with upper inner surface 53' of the notch at rear crossbar 18 rendering a limit stop. The limit stop prevents the forward rotation of rear legs R1 and R2 and subsequent upward rotation of seat member 22. When chair 12 assumes the folded position, seat member 22 is limited in rotating beyond the rear legs R1 and R2 by a second limit stop. Bottom surface 51" of hinge support 50 would be parallel and contiguous to the inner front surface 51' of the notch at rear crossbar 18.

In the exploded view FIG. 7, latches 56 comprises a cutout preferably at the bottom side for engaging torsion spring 57, and a longitudinal through-hole 59 for attachment of wire 42. Torsion spring 57 provides the necessary resistance for the latches 56 to return to its original position, and for maintaining attached wire 42 in tension. Pin 62 is fastened to seat member 22 and protrudes into the preferred groove 58, limiting the extention of latches 56 into socket 60 and retraction of latches 56 into socket 61 of socket encasement 63.

Figure 8:
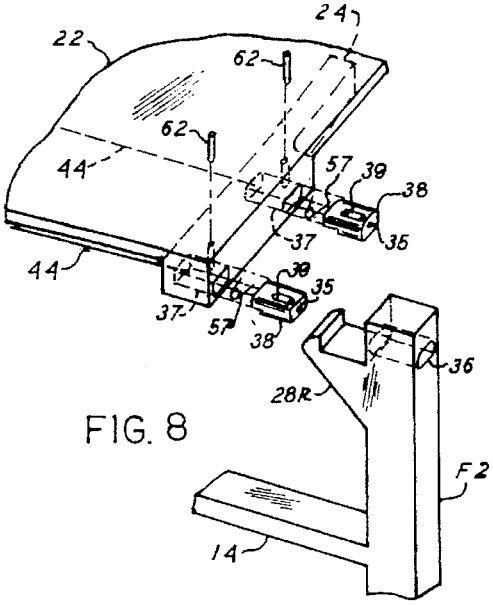
FIG. 8 shows an exploded partial three-dimensional view oil the seat support at the upper end of a front leg, and a locking device in accordance with the present invention.

Similarly, in the exploded view FIG. 8, latches 38 comprises a cutout preferably at the bottom side for engaging torsion spring 57, and a longitudinal through-hole 35 for attachment of wire 44. Torsion spring 57 provides the necessary resistance tier the latches 38 to return to its original position, and for maintaining attached wire 44 in tension. Wire 44 is fastened from one latch 38 to another latch 38 across seat member 22. Pin 62 is fastened to seat member 22 and protrudes into the preferred groove 39, limiting the extention of latches 38 into socket 36 and retraction into socket 37. Bracket 28R, and similarly 28L, support seat member 22 when chair 12 assumes the extended position.

Figure 10:
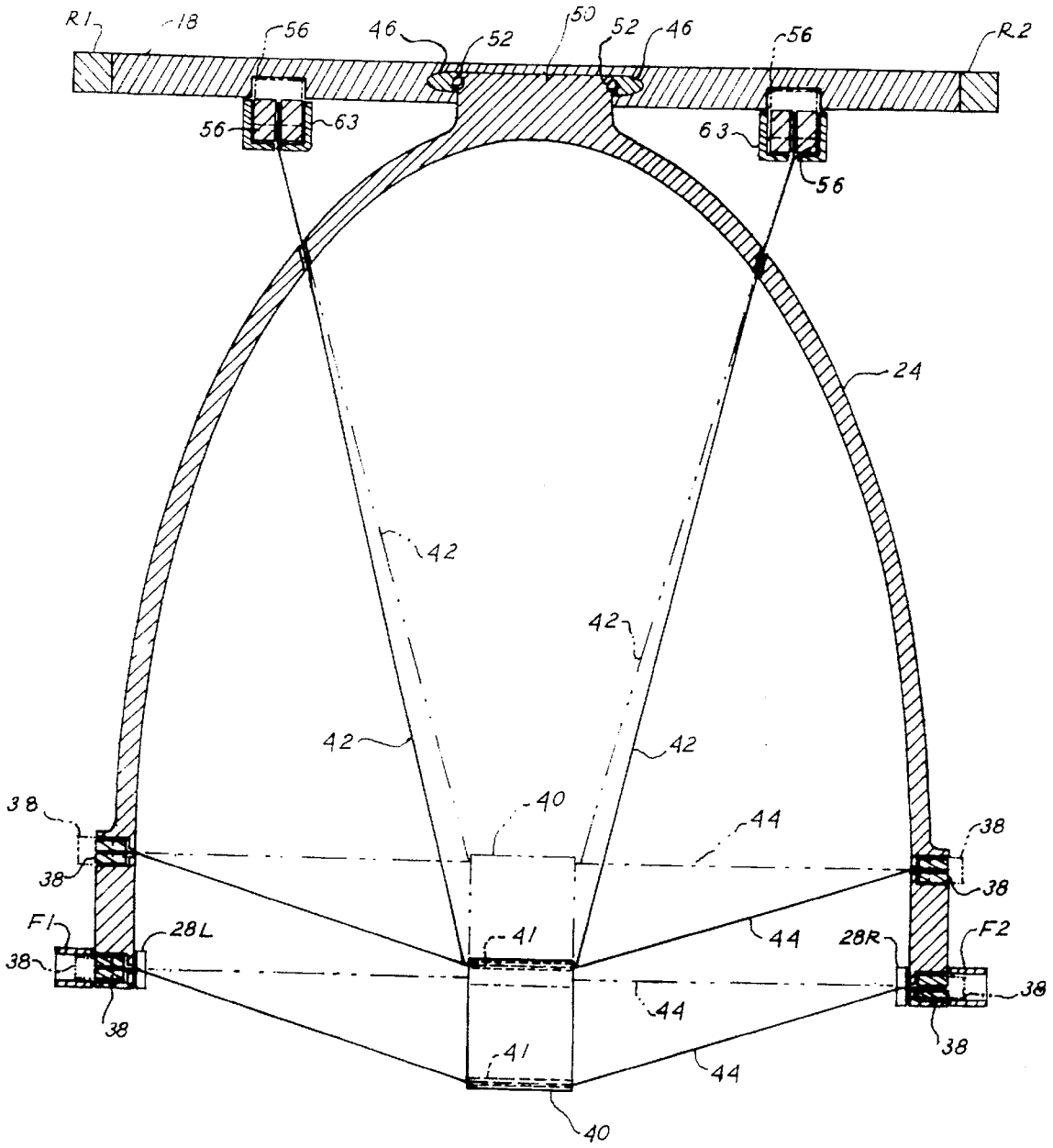

It will be revealed from FIG. 10, when chair 12 assumes the extended position, seat frame 24 is simultaneously secured to the rear crossbar 18 and to the upper portion of front legs F1 and F2 by latches 38 and latches 56. Thus, preventing the forward rotation and accidental collapse of chair 12. Wire 42 being fastened to wire 44 retracts latches 56 when handle 40 is pulled away from seat frame 24, thereby permitting chair 12 to assume the folded position. Latches 38 and 56 are manually retracted by pulling handle 40 away/from/front end of seat frame 24.

Figure 9:
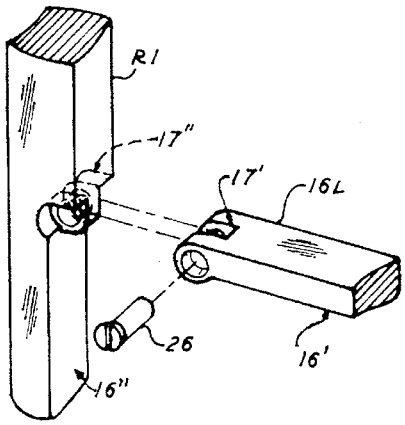
FIG. 9 shows an exploded partial three-dimensional view a pivot connection at a leg support with FIG. 10 shows a sectional plan view of a seat frame with a locking device in accordance with the present invention.

Each end of sidebars 16R and 16L is symmetrical so that FIG. 9 can serve to illustrate identical conditions in the extended position of chair 12. A load applied toward the front end of seat member 22 tends to rotate front legs F1 and F2 in its direction of collapsing by engagement of latches 38 and with brackets 28R and 28L. Subsequently, seat member 22 urges rear legs R1 and R2 via hinge support 50, to rotate forwardly and on top of sidebars 16R and 16L. However, the rotation of rear legs R1 and 112 is prevented by a limit stop when the top surface 17' of extremities of sidebars 16R and 16L and the upper surface of the rabbeted pivot means 17" are parallel and contiguous at sidebars 16R and 16L.

Similarly, in the extended position of chair 12, an applied load on back rest 20 causes the seat member 22 to rotate at hinge support 50 and sidebars 16R and 16L to rotate about pin fastener 16 in a forward and parallel like manner. This movement urges front legs F1 and F2 by engagement of latches 38, to rotate rearwardly and on top of sidebars 16R and 16L. However, this rotation of front legs F1 and F2 is prevented by a limit stop located at pin fastener 26. A limit stop is rendered when top surface 17' of extremities of sidebars 16R and 16L and the upper surface at the rabbeted pivot means 17" are parallel and contiguous.

SUMMARY, RAMIFICATIONS, AND SCOPE

Accordingly, the reader will see that the present invention, more particularly, relates to a folding chair that includes a front leg frame pivotable about a right and left sidebars, a left and right sidebar pivotable about a rear leg frame, a seat member pivotable about a rear crossbar articulated to rear leg frame, and a back rest fastened to the extended rear legs. The folding chair further includes a locking device to provide a sufficiently sturdy chair in-use position by engaging the seat to the front legs and to the rear crossbar. By releasing the locking device, the chair can be folded into a very flat panel and mounted onto a base support for parallel storage of multiple chairs and used as an aesthetically pleasing high quality area room divider. An alternate base support can used to store the chair in a stack like manner when not in-use, also providing an aesthetically pleasing piece of furniture. To provide for a sturdy chair in the folded flat panel position, the front portions of the seat, lower ends of the front legs, and lower ends of the rear legs are secured together by the locking device. This chair has the additional advantages in that it provides a very flat shape in the folded position that can be stored in minimal space, example, three-quarters of an inch would include the entire depth of one chair in the side elevation, and three inches would include the entire depth of four chairs;

it provides a use other than a chair when ganged together, particularly for a room as an area divider;

it provides for a chair that does not appear to be a folding piece of furniture chair since diagonal supports or non-orthogonal members for securing in-use operation is eliminated;

it allows for use with other types of furniture without being singled out as a folding piece of furniture; and it provides for a chair when in-use with a full back rest as large as and as comfortable as a fixed chair.

The present invention describes a foldable chair construction. Features of the present invention are recited in the appended claims. The drawings contained herein necessarily depict structural features and embodiments of the foldable chair construction, useful in the practice of the present invention.

However, it will be appreciated by those in skilled in the arts pertaining thereto, that the present invention can be practiced in various alternate forms and configurations. Further, the detailed descriptions of the preferred embodiments of the present invention, are presented for purposes of clarity of understanding only, and no unnecessary limitations should be implied therefrom. Finally, all appropriate mechanical, and functional equivalents to the above, which may be obvious to those skilled in the arts pertaining thereto, are considered to be encompassed within the claims of the present invention.

I claim:

1. A folding chair comprising rear legs including bottommost ends and uppermost ends, a rear crossbar connecting said rear legs, a back rest secured to said rear legs above said rear crossbar, a seal member comprising a rearward portion connected to said rear crossbar by a hinge means assembly, said seat member comprising a detachable frontal edge including detachable frontal lateral ends, said seat member rotates at said hinge means assembly from a substantially horizontal position to a substantially vertical position, said detachable lateral ends including front legs comprising bottommost ends and uppermost ends, said front legs connected by a front crossbar near the uppermost ends of said front legs, bracket means attached to the uppermost end of said front legs flanking the frontal lateral ends of said seat member, said bracket conforming to the frontal lateral ends of said seat member in a manner to brace said seat member for lateral support, sidebars connecting said front legs to said rear legs, said sidebars including a top and bottom surface, a first pivot means connected at points substantially midway between the uppermost ends and the bottommost ends of said front legs, a second pivot means connected at points from the bottommost ends of said rear legs substantially equal to the bottommost ends of said front legs to said first pivot means, whereby said sidebars are substantially parallel to said seat member when said chair is unfolded, said front legs rotate forwardly and underneath into parallelism to said sidebars at the first pivot means, therefrom said sidebars rotate forwardly at the second pivot means with said front legs into parallelism to said rear legs, whereby the bottommost ends of said front legs abut the bottommost ends of said rear legs, said chair in an unfolded condition further comprising a given height from a horizontal support of the uppermost ends of said rear legs whereby the height of said chair in a folded condition is increased substantially equal to the height of said front legs from the horizontal support.

2. A folding chair of claim 1, further comprising said front legs rabbeted from the bottommost ends to the first pivot means, whereby substantially half of said sidebars mate and converge to be substantially equal in cross sectional width to said front legs above the first pivot means, said rear legs rabbeted from the bottommost ends to the second pivot means, whereby substantially half of said sidebars mate and converge to be substantially equal in cross sectional width to said rear legs above the second pivot means, said chair further comprising a folding condition whereby said front and rear legs mated and converged with said sidebars are substantially coplanar and adjacent to said seat member.

3. A folding chair of claim 2, further comprising limit means at the first pivot means at forward ends of said sidebars, whereby said limit means prevents said front legs from rearwardly rotating and collapsing on top of said sidebars, limit means at the second pivot means at rearward ends of said sidebars, whereby said limit means prevents said rear legs from rotating and collapsing on top of said sidebars, the connection point of the first and second pivot means of said front and rear legs being rabbeted in a dovetail manner and conforming to said frontward and rearward ends of said sidebars respectively, inner surfaces at the connection points of the first and second pivot means, limit means comprising said top surfaces, said inner surfaces being contiguous and parallel when said chair is in an unfolded condition.

4. A folding chair of claim 3, further comprising said notch at said crossbar formed in a manner to limit rotation of said hinge assembly means from a horizontal position to a vertical position, said notch located between ends of said rear crossbar, whereby said seat member in the vertical position is nested within inverted front legs, said sidebars and within said rear legs, whereby said chair in a folded condition is a substantially flat panel.

5. A folding chair of claim 4, further comprising said hinge assembly means, a hinge support attached to said rearward portion of said seat member, said hinge support having concavities formed thereon, said rear crossbar having hollows adjacent to said notch, dowel inserts occupying said hollows and secured by fastener means, concavities formed on ends of said dowel inserts adjacent to said notch, ball bearings engaged into said concavities of said dowel inserts and said hinge support, said ball bearings located at approximate center of cross-section of said crossbar, whereby said ball bearings support occupant weight applied to said seat member and permit rotation of said seat member about said rear crossbar.

6. A folding chair of claim 5, further comprising latch means at said rearward portion of said seat member, latch means at the frontal lateral ends of said seat member, a first plurality of wires connecting said latch means to another at the frontal lateral ends of said seat member, a second plurality of wires connecting said latch means at said rearward portion of said seat member to said first plurality of wires, said latch means including a top surface with longitudinal grooves, a pin means fastened to said member and protruding into said groove thereby limiting movement of said latch means, a torsion spring whereby said wires are tension engaged with said latch means, means for simultaneously retracting said latch means, a grooved handle, said grooved handle is placed onto said wires and fastened thereto engaging said wires simultaneously when pulling said handle away from said frontward portion of said seat member.

7. A folding chair of claim 6, further comprising said seat member having plurality of sockets at said rearward portion and the frontal lateral ends of said seat member, said rear crossbar having matching plurality of sockets thereon to engage said latch means at said rearward portion of said seat member, said front legs having matching sockets near the uppermost ends and the bottommost ends, said rear legs having matching sockets near the bottommost ends, whereby said seat member carry within said sockets said latch means to engage with the uppermost ends of said front legs to the frontal lateral ends of said seat member, whereby said seat member carry within said sockets said latch means to engage said rearward portion of said seat member to said rear crossbar, thereby locking said chair in an unfolded condition, said latch means engages the frontal lateral ends of said seat member near the bottommost ends of said front legs and simultaneously to said rear legs near the bottommost ends thereby maintaining said chair in a folded condition.

8. A folding chair of claim 7, said chair in a folded condition further comprising a detachable base support means manually engaging said bracket means and said uppermost ends of said front legs.

* * * * *